United States Patent [19]

Collins et al.

[11] Patent Number: 4,591,090

[45] Date of Patent: May 27, 1986

[54] CARTON DIVIDER WITH PARTITION INTERLOCK

[75] Inventors: Thomas D. Collins, Kennesaw; Glenn D. Ross, Smyrna, both of Ga.

[73] Assignee: Sonoco Products Company, Hartsville, S.C.

[21] Appl. No.: 759,214

[22] Filed: Jul. 26, 1985

[51] Int. Cl.[4] ..... B65D 5/48

[52] U.S. Cl. ..... 229/15; 217/32; 229/42

[58] Field of Search ..... 229/15, 27, 28 R, 42; 217/30–33

[56] References Cited

U.S. PATENT DOCUMENTS

| | | | |
|---|---|---|---|
| Re. 31,176 | 3/1983 | Raubenheimer | 229/15 |
| D. 138,782 | 9/1944 | Schwartzberg | 217/30 |
| 235,575 | 12/1880 | Schroder | 217/32 |
| 324,999 | 8/1885 | Jaeger | 217/32 |
| 456,353 | 7/1891 | Bower | 217/32 |
| 529,173 | 11/1894 | Herr | 217/32 |
| 606,913 | 7/1898 | Bower | 217/32 |
| 1,006,716 | 10/1911 | Bloomer | 217/32 |
| 1,443,283 | 1/1923 | Showalter | 217/32 |
| 1,528,341 | 3/1925 | Navarro | 217/32 |
| 2,056,195 | 10/1936 | Inman | 217/30 |
| 2,673,656 | 3/1954 | Cunningham | 217/32 |
| 2,920,782 | 1/1960 | Butters | 217/32 |
| 4,071,185 | 1/1978 | Peters, Jr. | 229/28 R |
| 4,103,818 | 8/1978 | Raubenheimer | 229/15 |
| 4,194,675 | 3/1980 | Peters, Jr. | 229/15 |
| 4,358,047 | 11/1982 | Raubenheimer | 229/15 |

*Primary Examiner*—William Price
*Assistant Examiner*—Gary E. Elkins
*Attorney, Agent, or Firm*—Dennison, Meserole, Pollack & Scheiner

[57] ABSTRACT

A carton divider formed of crossing partitions interlocked by interengaged slots extending partially through the partitions from the opposite edges thereof. The slots include continuous hook slots having communicating inner, outer, and intermediate portions, and arrow slots divided into inner and outer portions by cross bars. Each hook slot intermediate portion defines a laterally directed tab extending through the inner portions of an arrow slot. The cross bar of the arrow slot in turn extends through the inner portion of the hook slot and is retained therein by a shoulder defined by the hook slot immediately inward of the tab and overlying the inner portion of the hook slot. The inner portions of both slots include areas narrower than the width of the remainder of the respective slots.

11 Claims, 9 Drawing Figures

CARTON DIVIDER WITH PARTITION INTERLOCK

BACKGROUND OF THE INVENTION

The invention herein relates to carton dividers of the type formed by two or more planar partitions crossing each other and interconnected by complementary internesting slots which allow for a selective folding and unfolding of the partitions, relative to each other, between a collapsed position wherein the partitions are in immediately adjacent overlying relation to each other and an unfolded or erected position wherein the partitions are in a cell-defining relation to each other, normally extending at right angles.

Such dividers, normally utilized within a surrounding carton and cooperating with the walls thereof, find primary use as a means for segregating and protecting products, for example bottles and like readily frangible items, in individual cells wherein each product can be peripherally stabilized and maintained out of direct contact with similarly packed products within the same carrying container or carton.

The partitions of the divider are conventionally formed of planar rectangular panels of fiberboard, cardboard, or the like. Such panels, while shape sustaining and incorporating a degree of rigidity in the plane thereof, are, because of the nature of the material and the thinness of the panel itself, easily laterally flexed or, upon the introduction of excess force, actually deformed. Accordingly, difficulties are frequently encountered in achieving both a positive interlocking of crossing partitions and a stabilization of the partition formed divider in the multiple positions assumed by the divider including a collapsed stored position and an expanded product receiving position.

Further, and particularly with the advent of automatic equipment for the insertion of partition-formed dividers, the tendency for the dividers to skew, that is partially or completely dissemble when supported at any one end, has also become a significant problem.

The problems associated with carton dividers have long been recognized and are further described in the following patents which also proposed suggested interlock constructions, including duplicate internesting slots, as a means for achieving partition stability:

U.S. Pat. No. 4,103,818; Raubenheimer,

U.S. Pat. No. Re. 31,176; Raubenheimer

U.S. Pat. No. 4,358,047; Raubenheimer

SUMMARY OF THE INVENTION

The present invention proposes a divider construction wherein the partitions are adapted for an automatic interlocking upon a bringing of the slots thereof into engaged nesting relationship. The slots themselves differ on the respective crossing partitions which, for purposes of description, will be referred to by the terms partitions and cross-partitions designating, respectively, longitudinally extending partition panels and the partition panels crossing or intersecting the longitudinal partition panels.

The slots, while internesting and complementary, are of distinctly different configurations formed to achieve a degree of security and stability, in combination with an enhanced ability to allow for a carton collapse and erection, hereto unavailable, particularly in constructions wherein a primary concern has been to form the internesting slots as duplicates of each other.

The slots are respectively designated as a hook slot and an arrow slot. The hook slot extends inwardly from one edge of the opposed parallel edges of the corresponding partition and terminates in a closed inner end beyond the center line of the panel. The hook slot includes longitudinally aligned elongate outer and inner portions with a laterally directed intermediate portion. The intermediate portion defines a laterally directed tab, within the plane of the partition panel, which projects a distance beyond the aligned outer and inner portions of the slot. The inner portion of the hook slot includes a lateral projection, oppositely directed relative to the tab of the intermediate portion, and defining, in conjunction with the opposed edge of the slot, the narrowest area of the slot along the entire length thereof. The side edge of the slot, within the inner portion and opposite the projection, is substantially planar and terminates, at the outer end thereof at or immediately adjacent to the intermediate section in a laterally directed shoulder projecting inwardly from the corresponding edge to the opposite edge in spaced relation above the projection extending from the opposite side edge. The slot, through the intermediate portion, while maintaining a generally parallel relation between the opposed side edges, is slightly wider than the slot throughout the remaining portions thereof. The extreme inner end of the slot terminates in an enlarged bulbous or teardrop configuration.

The arrow slot extends inwardly from one edge of the corresponding partition and is formed in two aligned portions, an outer linear portion and an inner portion separated therefrom by a transverse bridgeor bar integral with the partition. The inner portion includes a laterally enlarged opening or well immediately inward of the bridge and an elongate inwardly directed narrow or pinch area extending inwardly therefrom in alignment with the outer portion of the slot. This pinch area terminates in an inner bulbous or teardrop configuration defining the inner end of the arrow slot.

Upon an interengaging or internesting of the slots, the bar of the arrow slot engages within the inner portion of the hook slot and is closely retained by the projection. The projection tends to engage the bar of the arrow slot against the opposed flat wall of the inner portion of the hook slot and in underlying relation to the shoulder whereby outward movement of the bar, and hence the associated partition, is substantially precluded. The projection tends to provide for this positive positioning of the bar below the shoulder in all folded, unfolded or partially folded positions of the partition.

The interengagement of the slots also positions the projecting tab of the hook slot within the inner portion of the arrow slot and between the opposed slot sides at the elongate pinch or narrowed area inward of the enlarged opening or well. The lateral extension of the tab is such as to project well beyond the pinch area to positively overlie both the inner and outer surfaces of the partition to each side of the arrow slot inner portion.

The interlocked partitions are retained against accidental disengagement, present a minimum profile when folded, and incorporate an inherent tendency to move toward the unfolded position, thereby enhancing the stability of the partition in its unfolded, in use configuration.

Other structurally distinguishing features, objects and advantages of the invention will become apparent from a consideration of the following detailed description of the invention in conjunction with the accompanying drawings.

DESCRIPTION OF THE PREFERRED EMBODIMENT

Figure 1:
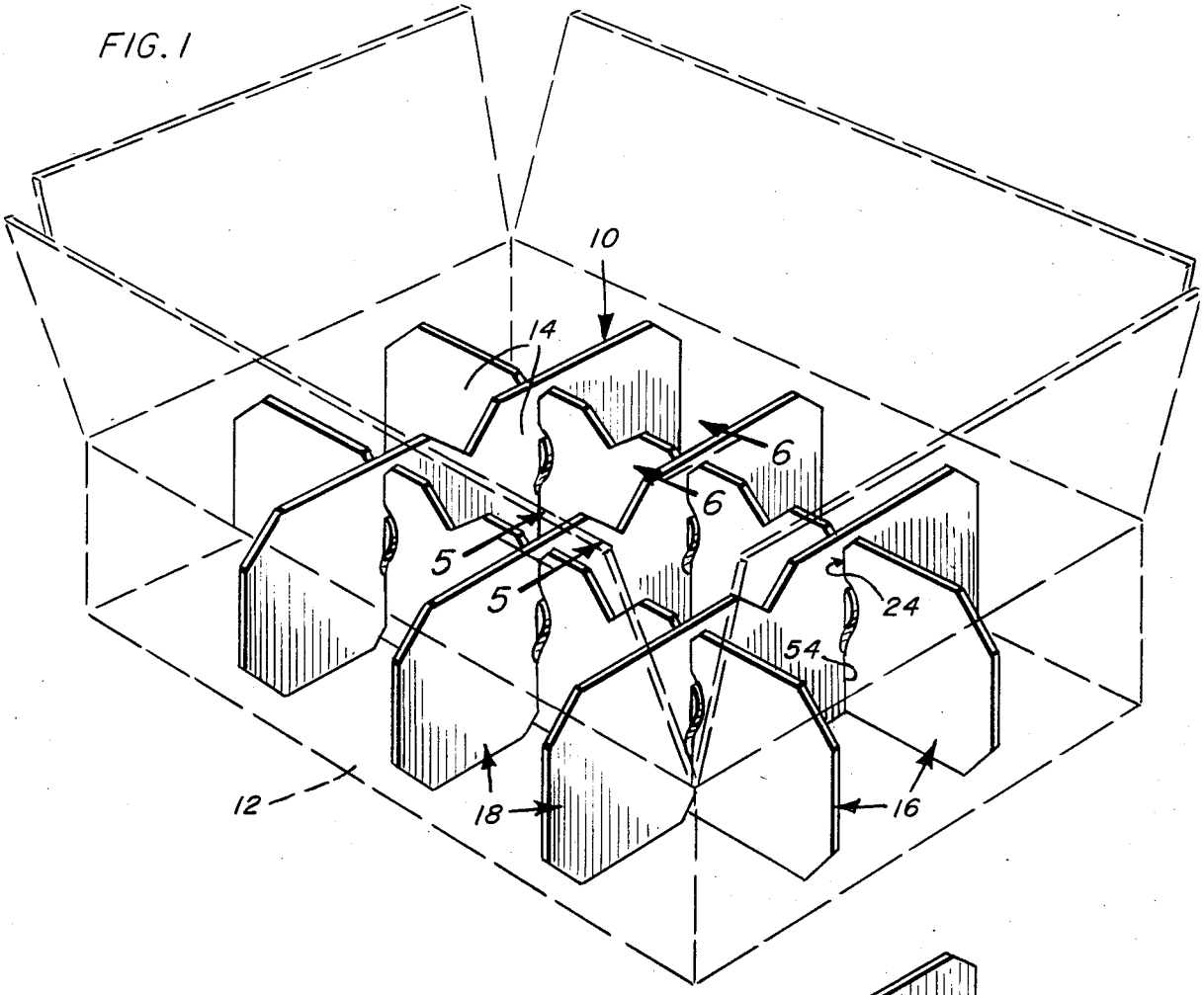
FIG. 1 is a perspective view of the assembled divider operatively positioned in a carton.

Referring now more specifically to the drawings, reference numeral 10 is used to generally designate the carton divider constructed in accord with the present invention. FIG. 1 illustrates the divider 10 fully assembled, erected in usable position within a carton or box 12, and defining individual product receiving cells 14 therein.

The carton divider 10 is defined by crossed interlocked partitions, preferably formed of fiberboard, cardboard, or the like. The partitions are of two types, differing basically in the construction of the interengaging slots as shall be described presently. For purposes of illustration and description, the partitions will be hereinafter designated as partitions or longitudinal partitions 16 and cross-partitions 18.

As will be appreciated, the number of partitions and cross-partitions provided will vary, depending upon the number of cells 14 to be defined by the divider 10. A typical divider may incorporate two longitudinal partitions 16 and three cross-partitions 18 as suggested in FIG. 1. However, either more partitions, or less, to a minimum of two, can be utilized. The invention herein is particularly concerned with the interlock provided between the longitudinal and cross-partitions, and as such is intended for use at every partition interlock, regardless of the number of such interlocks. For purposes of description and illustration, the disclosure will concern itself with the details of one such interlock and the component portions of a longitudinal partition and a cross-partition which contribute to the formation of the interlock.

Each longitudinal partition 16 is of a generally rectangular configuration including opposed longitudinal edges 20 and 22. A series of elongate hook slots 24 extend inwardly from one edge 20 in laterally spaced parallel relation to each other with the spacing between the hook slots 24, as well as the opposed end edges of the longitudinal partition 16, being determined by the desired width of the cells 14.

Each hook slot 24 extends from an outer end 26 opening through the edge 20 to a bulbous or teardrop shaped closed inner end 28 terminating short of the opposite edge 22 of the partition 16 with an aligned surface portion of the partition 16 extending between the closed inner end 28 of the hook slot 24 and the partition edge 22.

The hook slot 24 has opposed generally parallel side edges 30 and 32 which extend the full length of the slot between the open outer end 26 and the closed inner end 28. The slot 24 includes elongate generally linear and aligned outer and inner portions 34 and 36, and an intermediate portion 38. The intermediate portion 38 of the hook slot 24 extends along a laterally directed arcuate path, within the plane of the partition 16, which defines a laterally directed arcuate tab 40 extending a substantial distance laterally beyond the aligned outer and inner portions 34 and 36.

With specific reference to the inner portion 36, this portion defines the narrowest portion of the hook slot 24 with the corresponding length 42 of the slot side edge 32 being straight or flat and extending from the bulbous closed inner end 28 to a laterally directed shoulder 44 extending laterally toward the slot immediately adjacent the inner portion 36 relative to the intermediate portion 38.

The narrow configuration of the inner portion 36, which constitutes the narrowest portion of the slot 24, includes a projection 46 defined along the side edge 30 immediately opposite the straight edge portion 42 outward of closed inner end 28, defining in effect a pinch point of a width very slightly greater than the thickness of the panel material from which the equal thickness partitions 16 and cross-partitions 18 are made. It is contemplated that the width of the pinch point be approximately 112% of that of the thickness of the material thereby providing a relatively snug reception of the cross-partition 18, as shall be detailed subsequently, providing a substantial degree of stability while allowing for a desired pivotal movement.

The projection 46 projects laterally inward toward the edge portion 42 to a point at least in alignment with the inward extent of the overlying shoulder 44, and possibly slightly inward thereof, providing in effect a limited access recess inward of shoulder and laterally of projection 46.

The longitudinal centerline of the longitudinal partition 16, indicated by reference numeral 48, extends through the intermediate portion 38 immediately outward of the inner portion 36 and the shoulder 42, the hook slot 24 thus extending to both sides of the centerline 48.

Referring now specifically to the cross-partition, this partition is similarly formed of an elongate flat generally rectangular panel having opposed first and second longitudinal edges 50 and 52. The slots therein, for purposes of designation, are referred to as arrow slots 54. Each of the arrow slots 54, as illustrated, includes an elongate linear outer portion 56 and an inner portion 58 aligned with and separated from the outer portion by an integral transverse portion of the panel of the cross-partition, defining a bridge or cross bar 60. The arrow slot 54 has an open outer end 62 opening through the first edge 50. This open outer end is at the outer end of the outer portion 56 with the outer portion 56 being defined by opposed parallel slot edges 64 and 66 which extend inwardly from the open outer end 62 to the cross bar or bridge 60.

The inner portion 58 of the arrow slot 54 is similarly defined by continuations of the slot side edges 64 and 66 inward of the cross bar 60. These side edges terminate at and define a bulbous closed inner end 68, forming the inner end of the slot 54.

The inner portion 58 includes an elongate pinch zone or area 70 immediately outward of the closed inner end 68. This pinch zone 70 is of a width only slightly greater than the thickness of the material of the mating longitudinal partitions 16, generally on the order of 112% greater width, and defines the narrowest portion of the arrow slot 54. Immediately outward of the pinch area 70, the opposed side edges 64 and 66 flare outwardly and then extend generally parallel to rounded corners at the cross bar or bridge 60, defining an enlarged opening or well 72 generally immediately outward of the centerline 74 of the cross-partition 18 relative to the outer first edge 50.

The pinch zone 70 provides for substantially intimate engagement with the engaged complementary partition 16, providing a stable relationship between the panels 16 and 18 in conjunction with a positive interlocking thereof and a free pivotal relationship for the desired selective collapsing and unfolding of the panels of the divider when assembled. In conjunction therewith, the enlarged opening 72 is of significance in allowing for a maximum compacting of the interengaged partitions while at the same time retaining a maximum interlocked stability therebetween.

As with the hook slot 24, the arrow slot 54 terminates, inwardly, beyond the centerline 74 and short of or in spaced relation to the second longitudinal edge 52 to define an integral surface portion of the panel 74 between the inner end 68 of the arrow slot 54 and the second edge 52.

As will be appreciated from the drawings, the open outer ends 26 and 62 of the slots 24 and 54 can be outwardly flared to facilitate an interengagement of the slots and aligned surface portions. Further, other modifications can be made in the panels forming the partitions 16 and cross-partitions 18 to facilitate carton insertion, product introduction, and the like. For example, note the illustrated beveled corners on the various partition panels illustrated in FIGS. 1 and 2.

Figure 2:
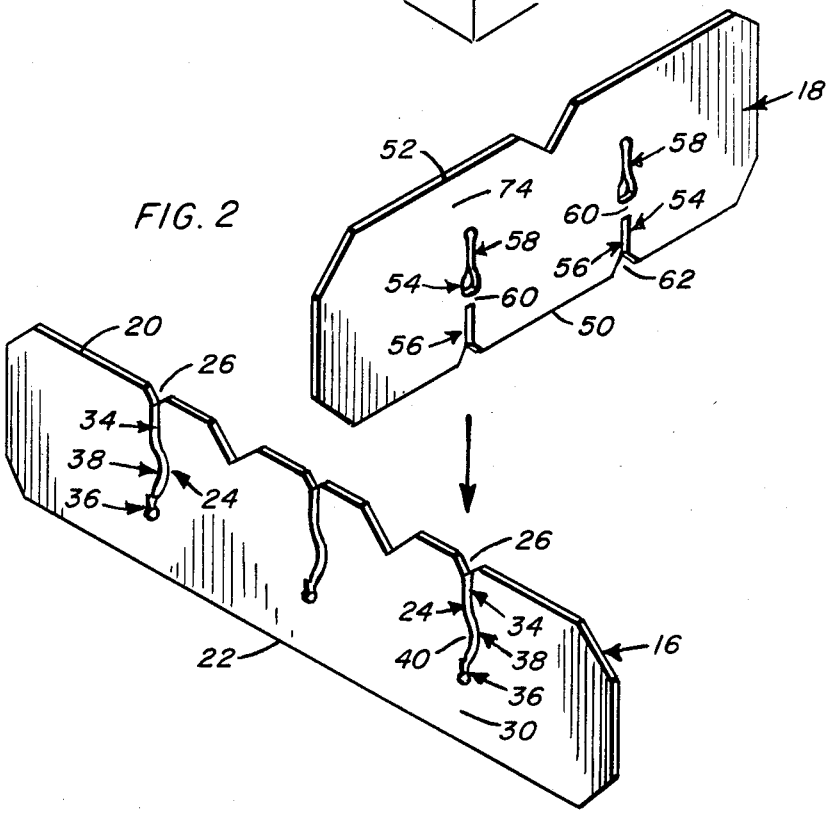
FIG. 2 is an exploded perspective view of the two basic partitions.
Figure 3:
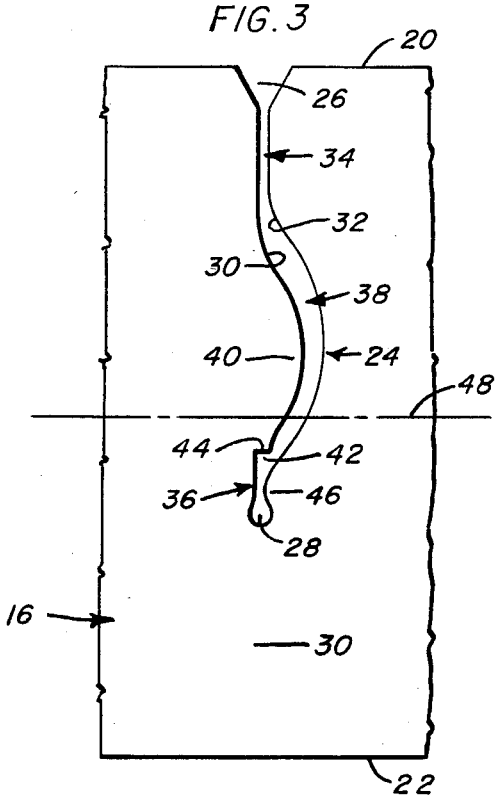
FIG. 3 is a partial plan view of the longitudinal partition illustrating the slot configuration.
Figure 4:
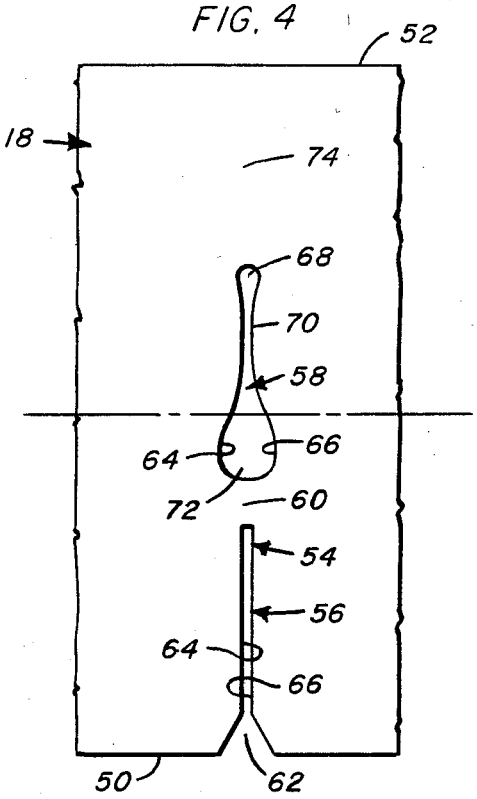
FIG. 4 is a partial plan view of the cross-partition illustrating the slot configuration therein.

FIG. 2 suggests the alignment and directional movement of the partition 16 and cross-partition 18 for an internesting of the slots 24 and 54, along with the aligned surface portions 30 and 74 to achieve the desired interlock, details of which will be best noted in FIGS. 5–9.

The flexible nature of the cardboard partition-forming panels is such as to enable an interlocking thereof through an alignment of the slots and a movement of the panels toward nested engagement, whether the panels are perpendicular to each other or at a folded or partially folded angle. The actual assembly will normally be effected on automatic assembly equipment. It is contemplated that the panels of the present invention be capable of assembly through the utilization of conventional equipment, notwithstanding the uniqueness of the slots themselves and the interrelationship therebetween.

When assembled, the cross bar 60 of cross-partition 18 seats within the inner portion 36 of the hook slot 24 of the longitudinal partition 16, engaging against the closed inner end 28 thereof. This cross bar 60 is retained against the flat edge portion 42, in spaced aligned relation inward of shoulder 44. The cross bar 60 is retained in position by the projection 46 which, with the opposed flat side edge length 42, defines a pinch area closely retaining the cross bar 60 in inner aligned relation relative to the shoulder 44. The tolerance between the opposed projection 46 and side edge portion 42 being such so as to closely confine the cross bar 60 to provide a substantial degree of stability while at the same time both positively retaining the cross bar 60 within the lower portion 36 and allowing for the desired pivotal folding between the partition panels.

Figure 5:
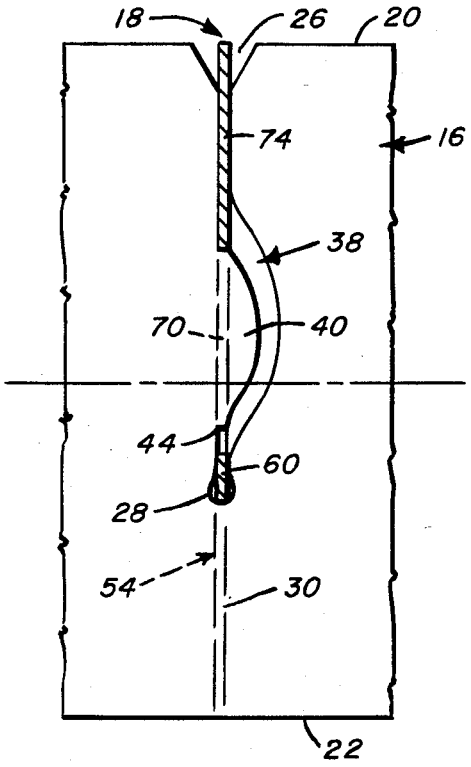
FIG. 5 is a cross-sectional detail taken substantially on a plane passing along line 5—5 in FIG. 1.
Figure 6:
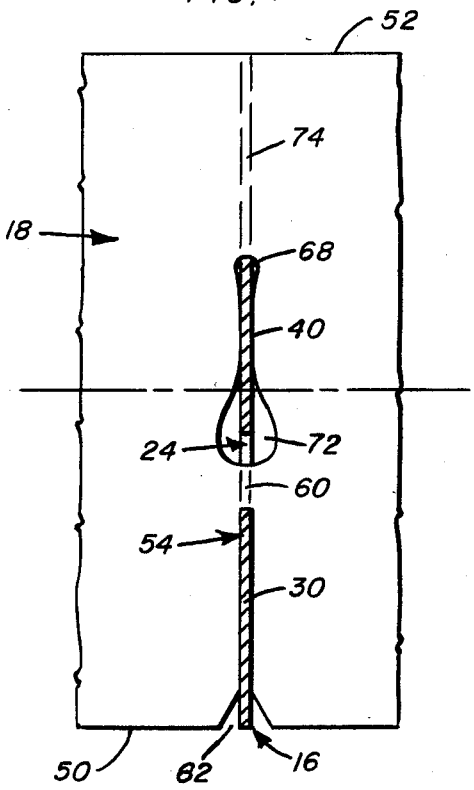
FIG. 6 is a cross-sectional detail taken substantially on a plane passing along line 6—6 in FIG. 1.
Figure 7:
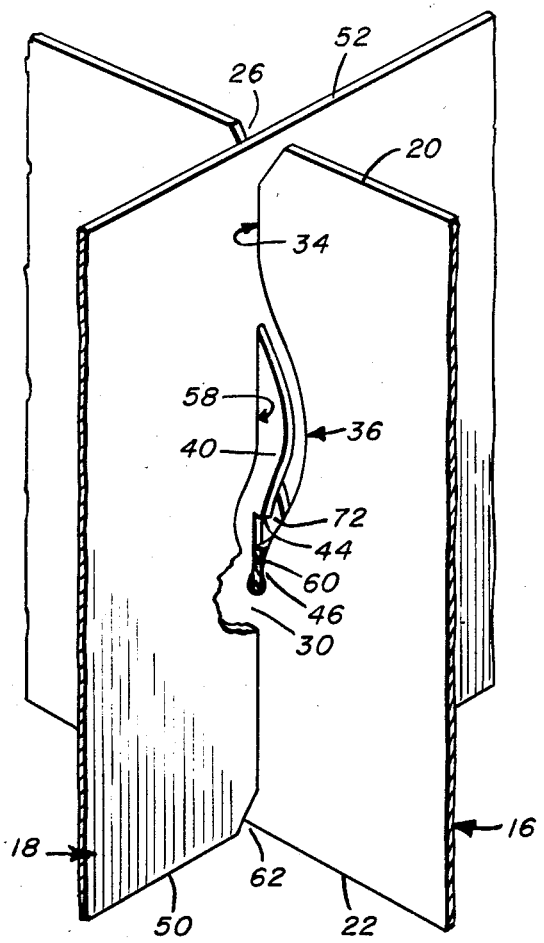
FIG. 7 is a partial perspective view of an assembled pair of partitions.

The actual retention of the cross bar 60 in the erected or unfolded carton divider should be readily apparent from FIGS. 5 and 7 in particular.

Figure 8:
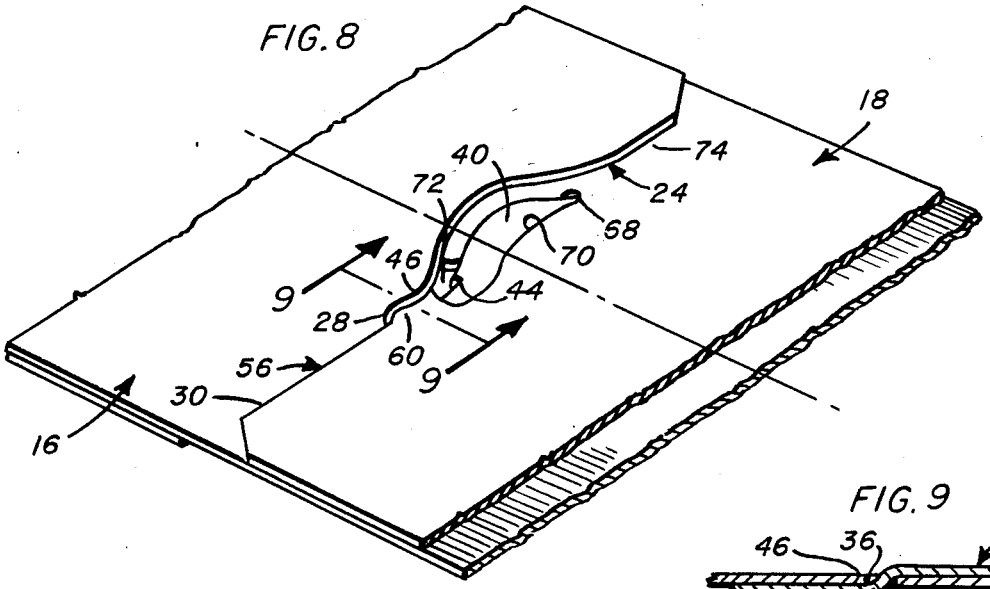
FIG. 8 is a partial perspective view of a pair of folded partitions.
Figure 9:
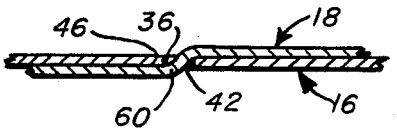
FIG. 9 is a cross-sectional detail taken substantially on a plane passing along line 9—9 in FIG. 8.

Noting FIGS. 8 and 9, it will also be appreciated that the cross bar 60 is "locked" within the inner portion 36 in the folded position of the partition panels, regardless of the direction of fold. This is basically effected in that the projection 46, depending upon the direction of folding of the cross-partition 18, either directly overlies or directly underlies the cross bar 60 causing a slight lateral deflection thereof relative to the opposed side edge portion 42 immediately adjacent this edge portion 42 and in alignment with the shoulder 44. As such, any outward sliding movement of the panels relative to each other will tend to engage the deflected cross bar 60 against the shoulder 44 and preclude further outward movement.

The projection and cross bar relationship performs another significant function in effecting a bias on the involved partition panels to move these panels toward an unfolded position. This results from the inherent resiliency of the cardboard material and is particularly desirable in tending to maintain the crossing partition and cross-partitions perpendicular to each other in an erected carton divider. Similarly, depending upon the particular equipment involved, the slight tendency for the panels to outwardly spring can facilitate the actual erection of the divider 10.

Simultaneous with engagement of the cross bar or bridge 60 within the inner portion 36 of the hook slot 24, the laterally projecting enlarged tap 40, associated with the intermediate portion 38 of the hook slot 24, is engaged within and through the inner portion 58 of the arrow slot 54 of cross-partition 18. This tab 40, as will be readily appreciated from FIGS. 5, 7 and 8, projects a substantial distance beyond the inner portion 58 of slot 54 in both the folded and unfolded positions of the partition panels, providing in effect a positive interlock.

With the slots 24 and 54 fully internested, the tab 40 is closely received through the pinch area 70 of the inner portion 58 with one linear extent of the tab 40 engaged in the inner portion 68 of the inner slot portion 58 and seated against the aligned solid surface portion 74. The other linear extreme of the tab 40 is received within the enlarged opening or well 72, terminating in the shoulder 44. The pinch area 70 provides for a relatively snug reception of the tab 40, thus substantially contributing to the stability of the erected divider and providing for a cooperative relationship between the tab and the overlying and underlying adjoining areas of the cross-partition 18, to each side of the inner slot portion 58, which tends to move the interengaged partition panels toward an open or unfolded position, supplementing and cooperating with the biasing action achieved between the projection 46 and cross bar 60 as previously detailed.

In internesting the slots 24 and 54, which, depending upon the equipment utilized, may be effected with the partition panels in folded or unfolded relation to each other, the cross bar tends to follow the rather smoothly configured tab through the intermediate portion 38 of the hook slot 24 and into the inner portion 36 thereof below the shoulder 44. This will, at the same time, automatically engage the tab 40 through and substantially beyond the inner portion 58 of the arrow slot 54. With the slots fully nested, any tendency for disengagement will be effectively resisted by the relationship between the shoulder 44, at the inner end of the tab 40, and the cross bar 60 inward thereof and retained in alignment therewith by the projection 46. This interlock relationship is maintained throughout the full range of movement of the partition and cross-partition relative to each other under normal folding and unfolding conditions.

It will be appreciated that, when fully internested, the positive interlock, particularly achieved by the tab and cross bar, and the relationship thereof to the partition panels to which they engage, is effected both inward and outward of the centerline, thus substantially contributing to a prevention of skewing. Further, the elongate pinch area associated with the inner portion of arrow slot 54, and the projection defined pinch area within the inner portion 36 of hook slot 24, also to opposite sides of the centerline, tend to maintain a positive control over the relationship between the partition panels, preventing any tendency for shifting or disorientation.

In summary, the elongate pinch area 70 and pinch point 36 remote therefrom offer very good control on the two partition panels, and thus tend to maintain tolerances on the cell sizes of the formed divider. In addition, these pinch positions tend to hold the partition panels perpendicular to each other with some recoil to the open or unfolded position. Similarly, when the partition panels are folded, there is an increased friction on the panels which prevents disorientation or skewing, regardless of the direction of fold. It is also significant that the particular configuration of the slots enables use of conventional assembly equipment and machinery.

The foregoing is considered illustrative of the principles of the invention with the scope of the invention being defined by the claims following hereinafter.

We claim:

1. In a carton divider defined by at least one generally planar partition and one generally planar cross-partition, each partition and cross-partition having first and second edges, with a locking slot extending inward from an open outer end at the first edge thereof and terminating at a closed inner end intermediate said edges, each said partition and cross-partition including a surface portion aligned with the corresponding slot and extending from the closed end thereof to the corresponding second edge, the slots and aligned surface portions being cooperatively interengageable for interlocking said partition and cross-partition into a cell-defining configuration; the slot in said partition having opposed generally parallel side edges between the open and closed ends thereof spaced apart a distance greater than the thickness of said cross-partition at said slot aligned surface portion thereof, said partition slot having elongate inner and outer portions in substantial linear alignment and extending respectively from the open and closed ends of the partition slot, said partition slot including an intermediate portion between and directly communicating said inner and outer portions, said intermediate portion extending laterally relative to the linear alignment of the inner and outer portions and forming a tab defined by one of said side edges and projecting from one side of said slot laterally beyond the linearly aligned inner and outer portions, a selected section of said partition slot, in said inner portion and outward of the closed inner end thereof, being narrower than the remainder of said partition slot inner portion and defining a pinch area for intimate confinement of the cross-partition therein; the slot in said cross-partition having opposed generally parallel side edges between the open and closed ends thereof spaced apart a distance greater than the thickness of said partition at said slot aligned surface portion thereof, said cross-partition slot having elongate inner and outer portions in substantially linear alignment and extending respectively from the open and closed ends of the cross-partition slot, and an intermediate surface section intermediate the inner and outer portions of the slot of the cross-partition defining a cross bar, said cross bar, upon an interengaging of said slots, engaging against the closed inner end of the partition slot inward of the laterally directed tab and within said pinch area of said partition slot, a selected section of said cross-partition slot, in the elongate inner portion and outward of the closed inner end thereof, being narrower than the remainder of said cross-partition slot inner portion and defining a pinch area for intimate confinement of the partition therein for engagement of the laterally directed tab therethrough and therebeyond upon interengaging of said slots.

2. The divider of claim 1 wherein each said pinch area comprises the narrowest section of the respective slot.

3. The divider of claim 2 wherein the pinch area of the slot of the partition is formed by a projection defined by the side edge opposed from said tab, said projection extending laterally of the corresponding slot in inwardly spaced relation to said tab.

4. The divider of claim 3 including an inwardly facing shoulder defined by the side edge defining said tab, said shoulder being inward of said tab adjacent the inner portion of the partition slot, said shoulder projecting laterally across at least a major width of said inner portion of the partition slot to restrict withdrawal of the cross bar from the engaged position thereof within said pinch area of the partition slot.

5. The divider of claim 4 wherein said shoulder projects beyond said inner portion of the partition slot in outwardly spaced relation to said pinch area therein.

6. The divider of claim 5 wherein the inner portion of the cross-partition slot, between the pinch area thereof and the cross bar, includes a laterally enlarged opening defined by an increase in the lateral distance between the opposed side edges of the cross-partition slot, said enlarged opening extending inward of said cross bar a distance sufficient to align the shoulder of said partition with an intermediate area within said laterally enlarged opening upon an interengagement of said slots.

7. The divider of claim 6 wherein said intermediate portion of said partition slot is generally curvilinear.

8. The divider of claim 7 wherein the closed inner end of each slot, inward of the corresponding pinch area, is of a bulbous configuration.

9. The divider of claim 1 including an inwardly facing shoulder defined by the side edge defining said tab, said shoulder being inward of said tab adjacent the inner portion of the partition slot, said shoulder projecting laterally across at least a major width of said inner portion of the partition slot to restrict withdrawal of the cross bar from the engaged position thereof within said pinch area of the partition slot.

10. The divider of claim 9 wherein the inner portion of the cross-partition slot, between the pinch area thereof and the cross bar, includes a laterally enlarged opening defined by an increase in the lateral distance between the opposed side edges of the cross-partition slot, said enlarged opening extending inward of said cross bar a distance sufficient to align the shoulder of said partition with an intermediate area within said laterally enlarged opening upon an interengagement of said slots.

11. The divider of claim 1 wherein the pinch area of the slot of the partition is formed by a projection defined by the side edge opposed from said tab, said projection extending laterally of the corresponding slot in inwardly spaced relation to said tab.

* * * * *